US006167994B1

(12) United States Patent
Kuo et al.

(10) Patent No.: US 6,167,994 B1
(45) Date of Patent: Jan. 2, 2001

(54) DURABLE DEVICE FOR WHEELED LUGGAGE

(75) Inventors: Chung-Hsien Kuo, Pan-Chiao; Chieh Chiun Chen, Hsin Chuang, both of (TW)

(73) Assignee: Chaw Khong Technology Co., Ltd., Taipei (TW)

( * ) Notice: Under 35 U.S.C. 154(b), the term of this patent shall be extended for 0 days.

(21) Appl. No.: 09/305,666

(22) Filed: May 5, 1999

(30) Foreign Application Priority Data

Oct. 30, 1998 (TW) ..... 87217954

(51) Int. Cl.[7] ..... A45C 5/14
(52) U.S. Cl. ..... 190/18 A; 301/111; 301/125
(58) Field of Search ..... 301/5, 111, 114, 301/121, 125, 126, 131; 190/18 A, 25, 37

(56) References Cited

U.S. PATENT DOCUMENTS 4,995,487 * 2/1991 Plath ..... 190/18 A
5,498,010 * 3/1996 Stube ..... 190/18 A X
5,524,734 * 6/1996 Wang ..... 190/18 A
5,531,300 * 7/1996 Tsai ..... 190/18 A X

* cited by examiner

*Primary Examiner*—Russell D. Stormer
(74) *Attorney, Agent, or Firm*—Dougherty & Troxwell

(57) ABSTRACT

A durable device for wheeled luggage is disclosed. The durable device, made of a highly durable material, raised above a rear side shell of the luggage for a predetermined distance, is mounted on a pedestal of the luggage and above a wheel for avoiding the scratch of the shell of the luggage when the luggage is carried in and out of buildings with ascending steps.

7 Claims, 5 Drawing Sheets

DURABLE DEVICE FOR WHEELED LUGGAGE

BACKGROUND OF THE INVENTION

1. Field of the Invention

The present invention relates to wheeled luggage, and more particularly to wheeled luggage with each of two durable devices mounted on a corresponding pedestal of the luggage.

2. Description of Related Art

Traditionally, luggage is provided with two wheels on two corners of the rear bottom and a retractable handle for easy carrying. The back side of the luggage (i.e., the side facing a person who carries the luggage) is tilted toward the person with the wheels rolling. It is often seen that the back side of the luggage comes into contact with a step when the luggage is carried in and out of a building with ascending steps. As a result, the back side, especially the portion near the wheels, is scratched. Hitherto, there is no proper device claimed to solve this problem.

Thus, it is desirable to provide a durable device for wheeled luggage to overcome the above drawback of prior art.

SUMMARY OF THE INVENTION

It is therefore an object of the present invention to provide a durable device for wheeled luggage wherein each of two durable devices is mounted on a corresponding pedestal of the luggage for avoiding the scratching of the luggage.

It is another object of the present invention to provide a durable device for wheeled luggage wherein the durable devices are simple in structure, easy to install, cost effective, and replaceable.

The above and other objects, features and advantages of the present invention will become apparent from the following detailed description taken with the accompanying drawings.

DETAILED DESCRIPTION OF PREFERRED EMBODIMENTS

Figure 1:
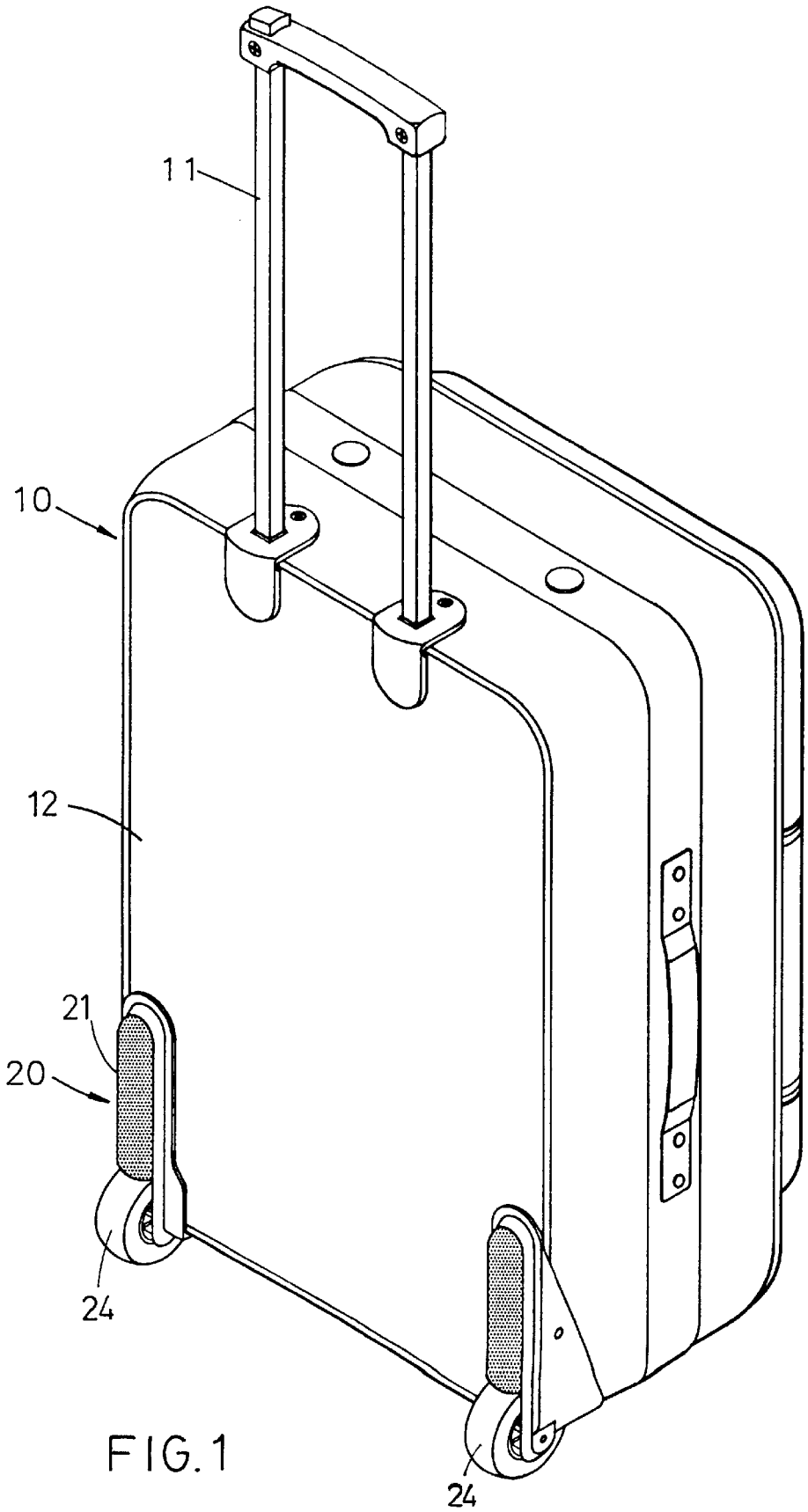
FIG. 1 is a perspective view of wheeled luggage of the present invention.

Referring to FIG. 1, there is shown wheeled luggage 10. The luggage 10 comprises two wheels 24 provided on two corners of the bottom, a back side shell 12, a pair of pedestals 20, a pair of durable devices 21 each mounted on a corresponding pedestal 20, and a retractable handle 11 for easy carrying.

Figure 2:
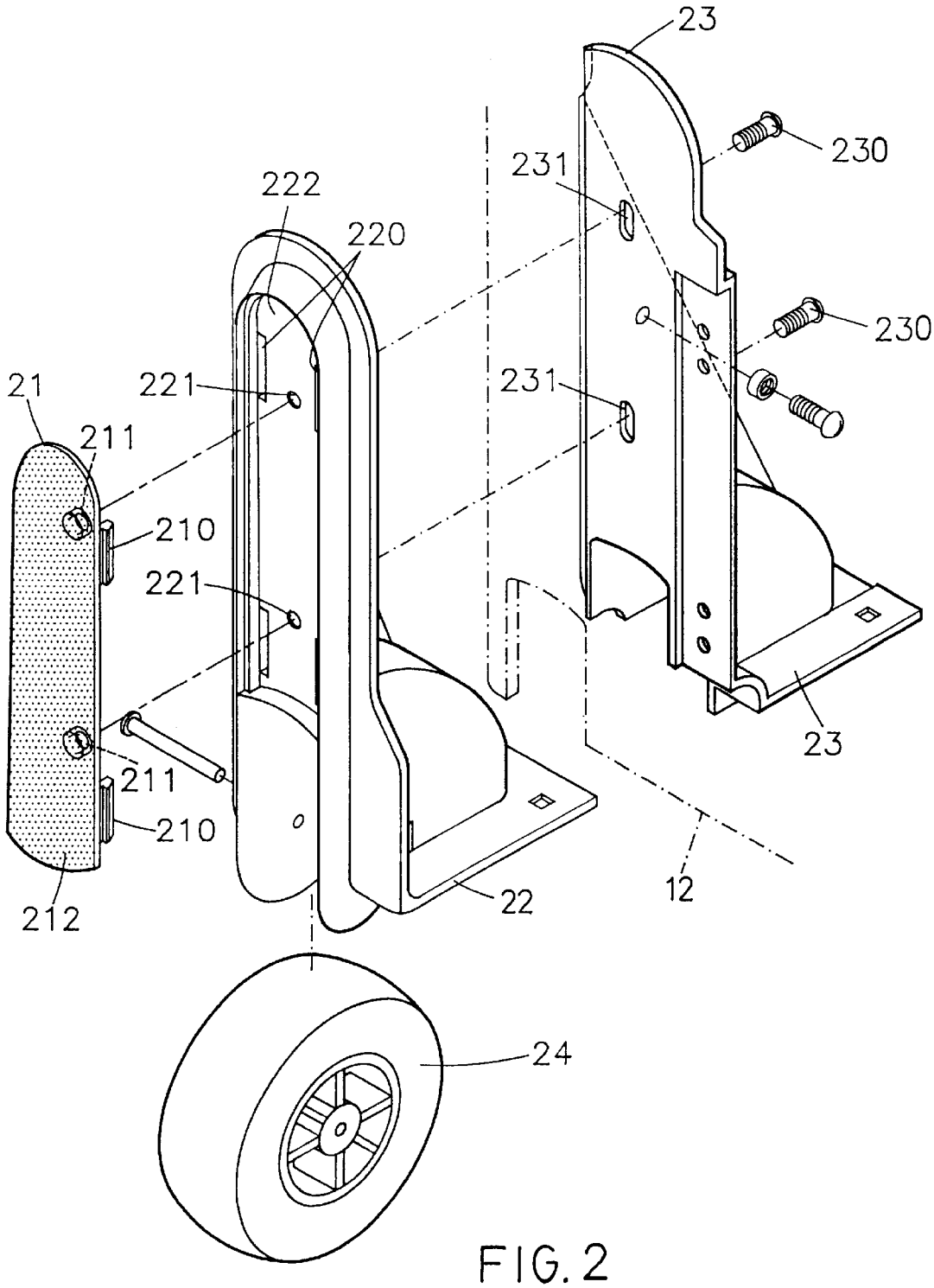
FIG. 2 is an exploded view of a durable device of the present invention.

Referring to FIG. 2, there is shown every element of the pedestal 20, the durable device 21, and the wheel 24. The durable device 21 is made of a highly durable material comprising a long convex plate 212, four projections 210 (only two shown) provided on the sides of the plate 212, and two recesses 211 provided between two sides of the back surface of the plate 212. The pedestal 20 comprises an outer pedestal 22 and an inner pedestal 23. The outer pedestal 22 comprises a recessed portion 222, two through holes 221 provided between two sides of the recessed portion 222, and four recesses 220 provided on the two sides of the recessed portion 222. The inner pedestal 23 comprises two screws 230 and two openings 231.

The assembly of the durable device 21, the outer pedestal 22, the shell 12 and the inner pedestal 23 is as follows:

a) cling each of the four projections 210 of the durable device 21 to four corresponding recesses 220; and b) then screw each of the two screws 230 through two corresponding openings 231, the shell 12 and a corresponding through hole 221 to a corresponding recess 211 securely.

Figure 3:
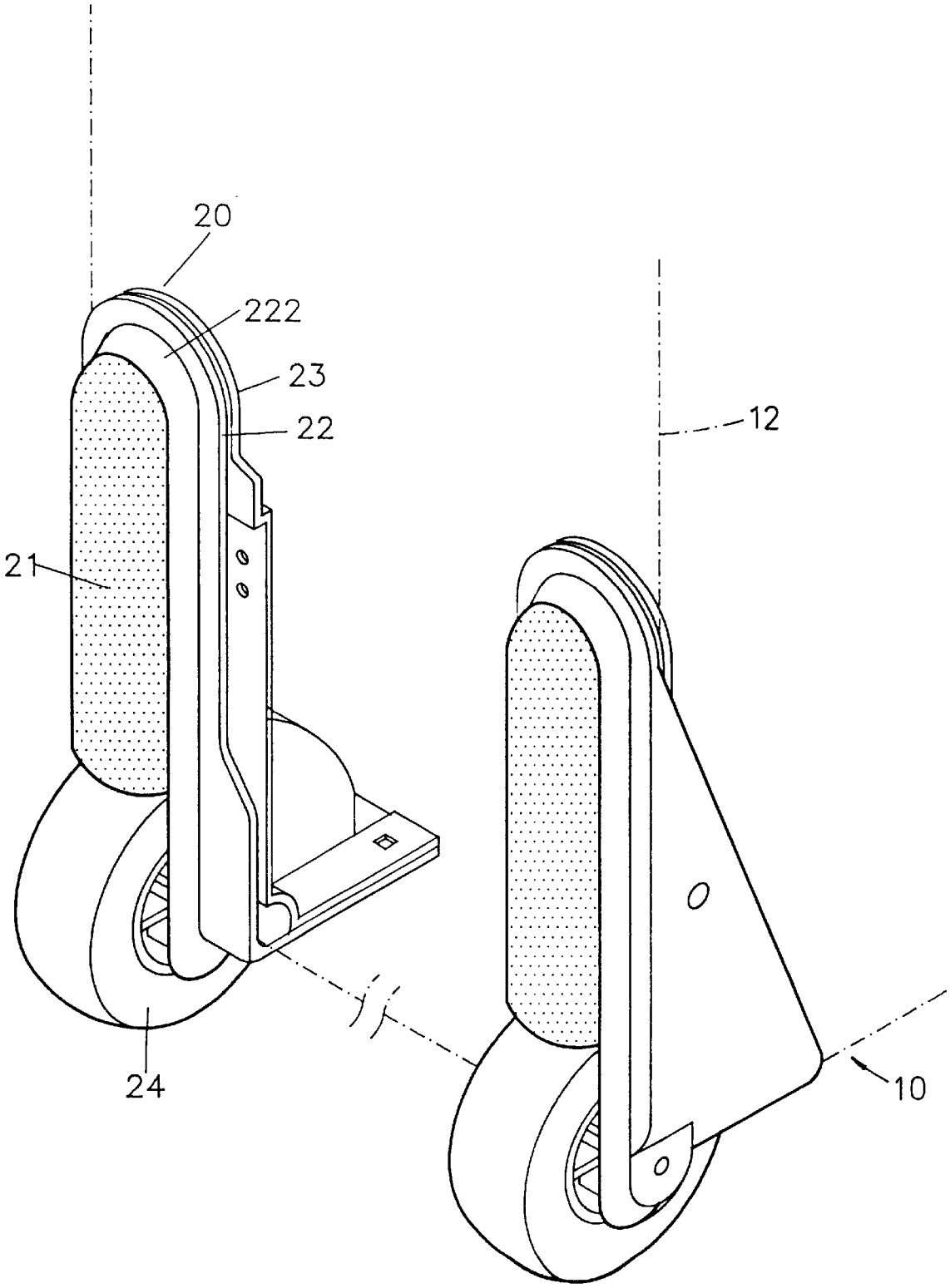
FIG. 3 is a perspective view of the assembled durable device of the present invention.

Referring to FIG. 3, there is shown a perspective view of the assembled durable device 21. It is evident that the durable devices 21 are raised above the surface of the shell 12 for a predetermined distance such that the durable devices 21 first come into contact with an outside article (e.g., a step) when the luggage 10 is approaching the outside article. As a result, the possible scratching of the shell 12 of the luggage 10 is completely avoided.

Figure 4:
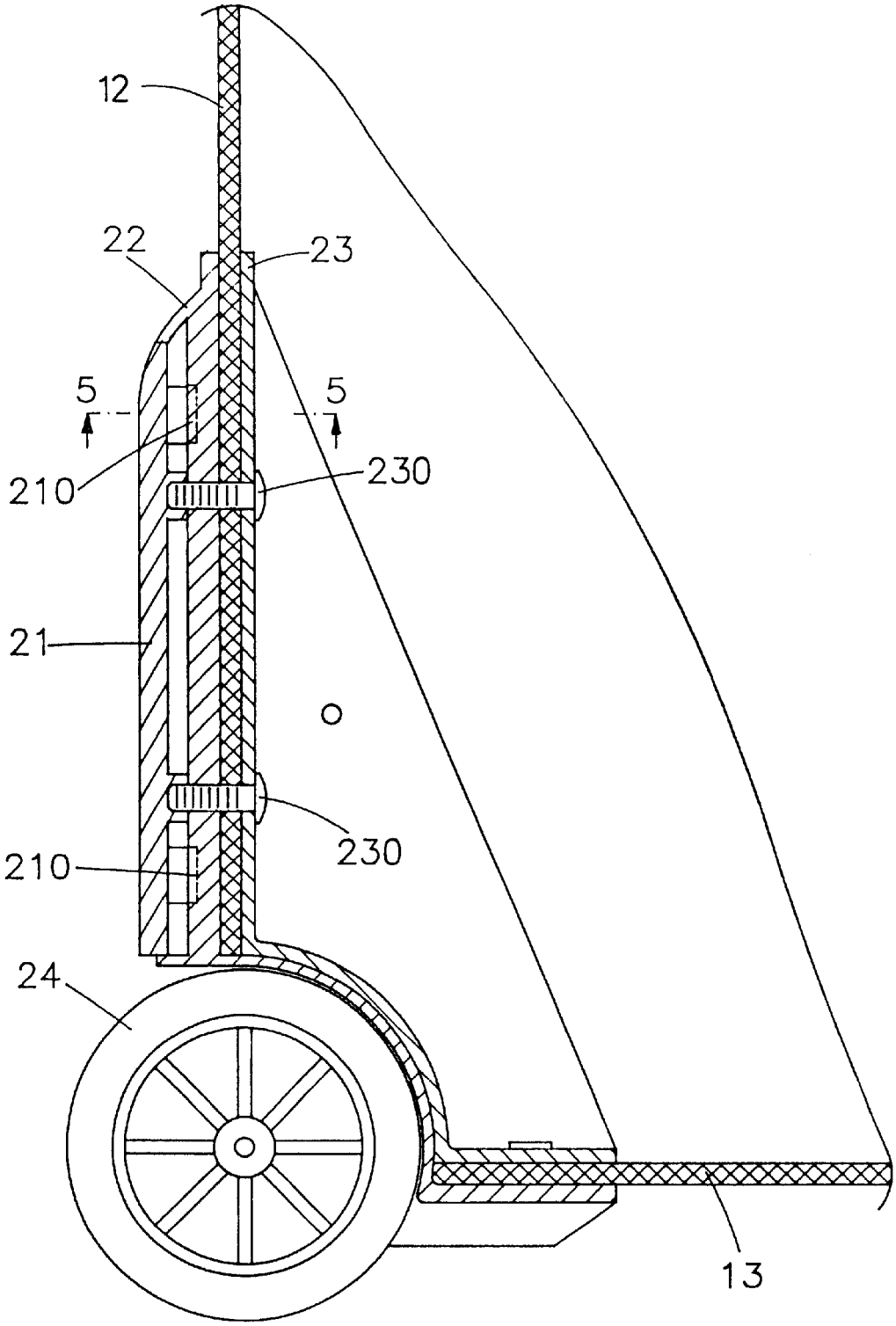
FIG. 4 is a sectional view of FIG. 3.
Figure 5:
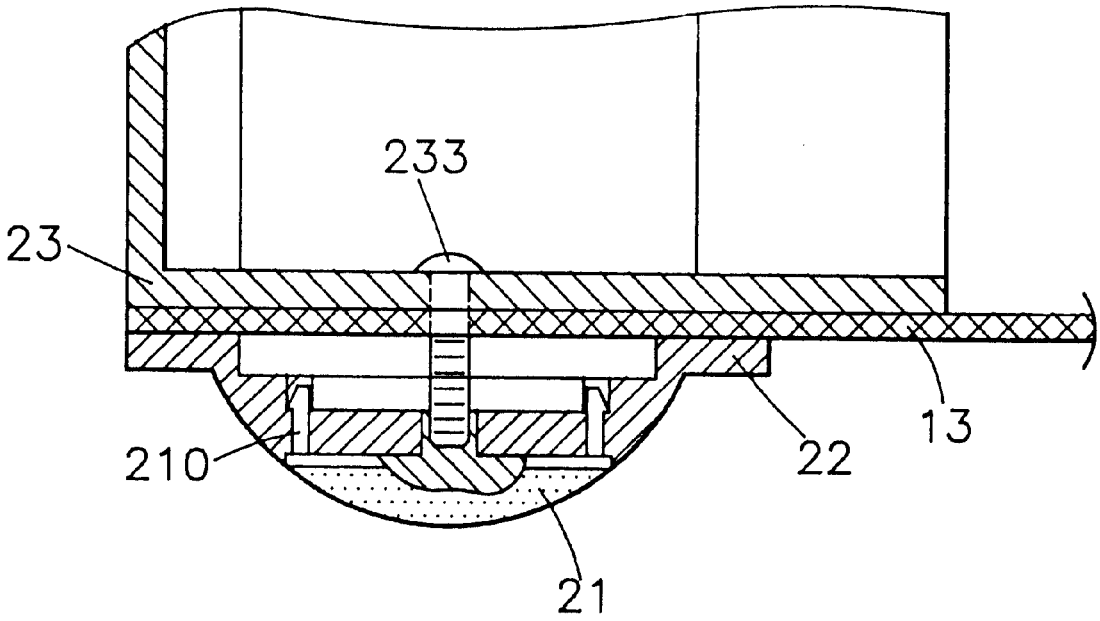
FIG. 5 is a sectional view taken along line 5—5 of FIG. 4.

Referring to FIGS. 4–5, there are shown two sectional view of FIG. 3. It is seen that once the durable devices 21 are worn-out it is possible to replace the durable device 21 with a new one by unfastening the screws 230 and separating the durable device 21 and outer pedestal 22 because as described above, the durable device 21 is secured firmly to the outer pedestal 22 simply by clinging four projections 210 to four corresponding recesses 220 (not shown).

While the durable devices 21 are mounted on the back side shell 12 of the luggage 10 near the pedestals 20 as shown herein, it will be understood it is not necessary to limit the location of the durable devices 21 to be exact as that of the illustrated embodiment of the present invention. It is possible for the present invention to be implemented in other portions of the luggage that often come into contact with outside articles.

While the invention herein disclosed has been described by means of specific embodiments, numerous modifications and variations could be made thereto by those skilled in the art without departing from the scope of the invention set forth in the claims.

What is claimed is:

1. A durable device for wheeled luggage, having a shell, the durable device comprising a plate member, made of a highly durable material, displaced from the shell of the luggage a predetermined distance, the plate member including a plurality of projections extending from a back surface of the plate member and a plurality of first recesses provided on the back surface of the plate member; and, a pedestal assembly comprising an outer pedestal provided on an outside of said luggage shell, and an inner pedestal provided on an inside of said luggage shell, the outer pedestal having a plurality of second recesses;

wherein said plate member of the durable device is mounted to said outer pedestal by said plurality of projections provided on the back surface of said plate member engaging with said plurality of second recesses provided on said outer pedestal, such that the plate member is located at the outer pedestal above a luggage wheel for avoiding the scratching of the shell of the luggage when the luggage is carried.

2. The durable device for wheeled luggage of claim 1, wherein the durable device is provided on a rear side surface of the luggage.

3. The durable device for wheeled luggage of claim 1, wherein the durable device has an elongated, convex shape.

4. The durable device for wheeled luggage of claim 1, wherein each of the plurality of projections is secured to one of the plurality of second recesses respectively.

5. The durable device for wheeled luggage of claim 1, wherein said outer pedestal comprises a recessed portion, a plurality of through holes provided in the recessed portion and the plurality of second recesses being provided on two opposite sides of the recessed portion.

6. The durable device for wheeled luggage of claim 1, wherein said inner pedestal is attached to the plate member by a plurality of screws engaging the plurality of first recesses.

7. The durable device for wheeled luggage of claim 6, wherein each of the plurality of screws passes through the inner pedestal, the shell of the luggage, the outer pedestal and engages a corresponding first recess, respectively.

* * * * *